US006270022B1

(12) United States Patent
Knapp

(10) Patent No.: US 6,270,022 B1
(45) Date of Patent: Aug. 7, 2001

(54) MULTIPLE JET SHOWER WITH AERATION DEVICE

(75) Inventor: Alfons Knapp, Klockstr (DE)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/424,947

(22) PCT Filed: May 20, 1998

(86) PCT No.: PCT/US98/10306

§ 371 Date: Dec. 3, 1999

§ 102(e) Date: Dec. 3, 1999

(87) PCT Pub. No.: WO98/55704

PCT Pub. Date: Dec. 10, 1998

(30) Foreign Application Priority Data

Jun. 3, 1997 (IT) ..... T097A0481

(51) Int. Cl.[7] ..... E03C 1/08

(52) U.S. Cl. ..... 239/428.5; 239/601; 239/553; 4/615

(58) Field of Search ..... 239/428.5, 601, 239/655.3, 533.3, 533.5; 4/615

(56) References Cited

U.S. PATENT DOCUMENTS 2,670,942 * 3/1954 Aghnides .
2,962,224 * 11/1960 Aghnides .
2,998,928 9/1961 Aghnides .
2,998,933 9/1961 Aghnides .
4,135,670 1/1979 Sugimoto .
5,054,688 * 10/1991 Grindley .
5,111,994 * 5/1992 Gonzalez .
5,172,862 12/1992 Heimann et al. .
5,467,929 * 11/1995 Bosio .

* cited by examiner

*Primary Examiner*—David A. Scherbel
*Assistant Examiner*—Christopher S. Kim
(74) *Attorney, Agent, or Firm*—Reising, Ethington, Barnes, Kisselle, Learman & McCulloch, PC

(57) ABSTRACT

An aerating device for a shower where the shower includes a water chamber having a connection for the supply of pressurized water and having a first perforated plate that forms a wall of the water chamber and that is provided with a plurality of holes. Each hole of the first plate is constructed as to project a single jet of water. The aerating device comprises a second perforated plate, positioned downstream from the first plate, to make an air chamber between the two plates. The second plate has a plurality of holes, each of which is aligned along the direction of projection of the respective jet of water of a corresponding hole of the first plate. An air intake is positioned between the air chamber and the outside environment. The aerating device makes it possible to aerate by way of the Venturi effect, at the outlet of the shower to eliminate any resistance after the jets have been formed for providing a highly efficient device.

17 Claims, 2 Drawing Sheets

MULTIPLE JET SHOWER WITH AERATION DEVICE

TECHNICAL FIELD

This invention relates to a device for the aeration of a multiple jet shower that can be a fixed showerhead or a hand-held small showerhead.

BACKGROUND OF THE DISCLOSURE

It is sometimes desired that the jet of a shower be aerated because, the shower produces a more pleasing sensation. Furthermore, the shower is rendered more efficient so that it becomes possible to perform a satisfactory operation with less water consumption.

Aeration devices are provided for this purpose. They are inserted up-stream from the showerhead and comprise a neck intended to speed up the flow of water that is piped to the shower and a chamber with an air intake that surrounds the water flow. The outside ambient air is thus aspirated into the shower by virtue of the Venturi effect from the accelerated flow and is incorporated in the water that is piped to the shower. The efficiency of these devices is high when the aerated jet thus obtained is used directly as flow for the shower, for example, as shown in U.S. Pat. No. 4,573,639. However, when the aerated device is inserted up-stream from the perforated plate that produces the jets of a multiple jet shower, the shower's efficiency is reduced because of the resistance that the plate puts up against the flow of water. Moreover, when an aeration device is inserted upstream of the plate, lime deposits are soon formed on the plate.

It is desired, therefore, to provide a device that is easily and economically manufactured on an industrial scale and that aerates a multiple jet shower with a great degree of efficiency.

SUMMARY OF THE DISCLOSURE

According to the invention, a shower includes a water chamber having a connection to supply pressurized water and having a first perforated plate that forms a wall of the water chamber and that is provided with a plurality of holes. Each hole of the first plate is positioned to project a single jet of water. The multiple jets are aerated by an aeration device that comprises a second perforated plate arranged down-stream from the first plate to produce an air chamber between the two plates. The second plate has a plurality of holes, each of which is aligned with the direction of projection of a respective water jet of a corresponding hole of the first plate. An air intake is arranged between the air chamber and the outside ambient environment.

Each individual jet that emanates in an accelerated fashion from a hole of the first plate then penetrates a corresponding hole of the second plate. By virtue of the Venturi effect the jet aspirates air from the air chamber that is present between the two plates and incorporates it, coming out thus aerated from the corresponding hole of the second plate. The air aspirated from the air chamber is replenished from the outside ambient environment through an air intake. The device according to the invention, thus makes it possible to individually aerate, also by virtue of the Venturi effect, each jet of the multiple jet shower in an economical and easily manufactured construction. Since this aeration takes place at the outlet of the shower, the aerated jets no longer encounter any resistance after they have been formed, and this makes the device highly efficient. Furthermore, because the aeration of the jets takes place downstream of the first plate, the formation of lime deposits is greatly reduced or avoided.

A device, according to the invention, can be permanently built into a shower head or it can be in the form of an accessory, intended to be attached or mounted to an existing shower. Furthermore, the device can be installed in a permanent manner so that the shower head must form aerated jets, or the device can be mounted in a removable manner, thus enabling the user to employ or not employ the device, depending on whether he wants to use the shower with aerated or nonaerated jets.

The device, according to the invention, furthermore, can be constructed to aerate all of the individual jets coming from the holes of the first plate, or only a portion of them. For example, it can aerate only the peripheral jets, leaving the central jets unchanged, or vice versa. In another pattern, alternate jets may be aerated.

The air intake for the air chamber, positioned between the two plates can be formed by apertures situated on the peripheral side of the air chamber and extending perpendicularly to the general direction of projection of the water jets. Alternatively, the intake can be formed by apertures situated about the peripheral portion of the air chamber and extending parallel to the general direction of projection of the water jets. In a different embodiment, the intake can be made up of apertures made in the second plate that corresponds to regions in which no holes of the first plate are aligned or where the corresponding jets are not intended to be aerated.

The holes of the first plate or the holes of the second plate or the holes of both plates together can be shaped to promote aeration. In particular, the holes of the first plate can be flared along all or part of their length, becoming wider in the direction of flow, and they can cooperate with holes of the second plate that are also flared or parallel and that have a plate that is greater than the maximum diameter of the holes of the first plate. In another embodiment, the holes of the first plate can be narrowed, for example, close to their outlet, and they can cooperate with holes of the second plate that have a considerably larger diameter. In this last case, the holes of the first plate can have a neck crest at their outlet or in some other suitable position that causes the outgoing water flow to be widened.

Moreover, if desired, the apertures may be designed and sized in both plates to produce multiple jets that form discontinuous streams of separate drops commonly referred to as "rain jets" rather than a continuous jet.

The device, according to the invention, can be made in any of the shapes in which a shower can be made and, hence, in particular, in an elongated linear or substantially circular form, and the shower, equipped with the device, according to the invention, can be a fixed showerhead or a hand-held showerhead. The plates need not be flat but can be contoured to accommodate any shower design.

BRIEF DESCRIPTION OF THE DRAWINGS

Reference is now made to the accompanying drawings in which.

DETAILED DESCRIPTION OF THE PREFERRED EMBODIMENT

Figures 1, 2, 3, 4, 5, 6:
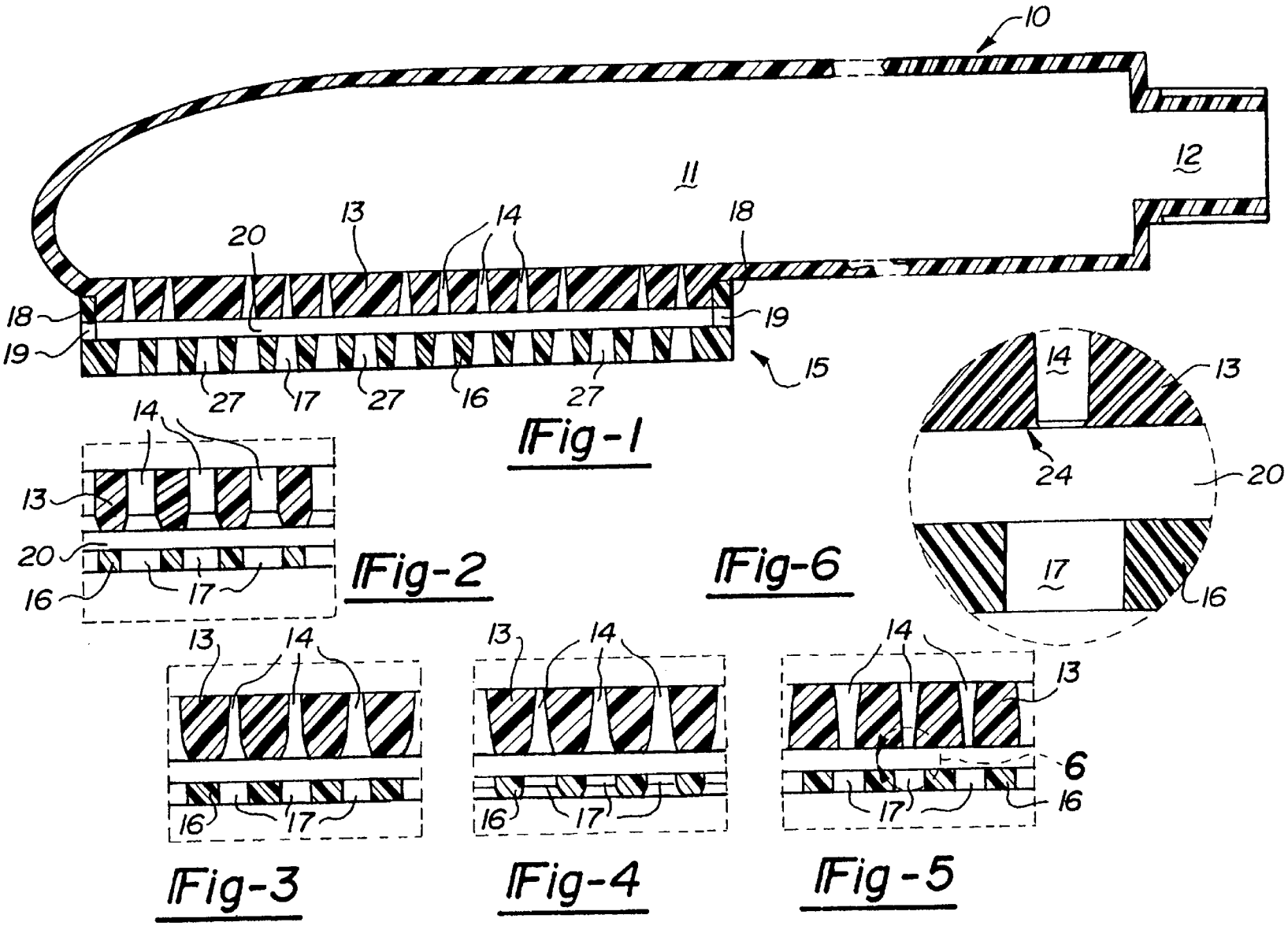
FIG. 1 is a side elevational and segmented view of a showerhead provided with a aeration device, according to one embodiment of the invention.
FIGS. 2 to 5 are fragmentary elevational segmented views illustrating other embodiments of the invention as regards the configuration of the holes in the first and second plates.
FIG. 6 is an enlarged modified detail, taken about the marked 6 in FIG. 5.

With reference to FIG. 1, a shower head housing 10 comprises a water chamber 11 having a supply connection 12 for the supply of pressurized water and having a first perforated plate 13 that forms a wall of said water chamber. The plate 13 is provided with a plurality of holes 14 that have a small cross-section. The plate 13 as shown is integrally formed with the shower head housing 10 but it is foreseen that separate plates may be mounted onto housing 10. Each hole 14 of the first plate 13 is arranged to project a single water jet, taken together form the multiple jets of the shower that is both well known and popular. The jets can be arranged in various formations such as an elongated linear, circular, or eliptical pattern in the manner of a fixed showerhead for a hand-held shower. The plate 13 can be positioned laterally, as in the illustrated form for a hand held shower, or axially at the end of a fixed showerhead.

In the customary showers of this type, each jet coming out of one of the holes 14 is compact i.e. non-aerated and continuous. It has, however, been found that if the jets are aerated, the jet streams now permeated with air feel softer and the many users derive a more pleasing sensation from this type of aerated jet. Furthermore, the shower turns out to be considerably more efficient and can be usefully operated with less water consumption, something that is particularly important where water is scarce or water drainage needs to be carefully managed.

In order to aerate the multiple jets of a shower, such as the one described so far, the invention provides for an aeration device 15 that comprises a second perforated plate 16 arranged downstream from the first plate 13. An air chamber 20 is formed between the two plates 13 and 16. The second plate 16 has a plurality of holes 17, and each hole 17 is arranged along the direction of the projection of the single water jet of a corresponding hole 14 of the first plate 13. In other words, holes 17 of the second plate 16 are exactly aligned with the corresponding holes 14 of the first plate 13, to receive the respective discharge of the water jets from holes 14.

Aeration device 15 can be secured or mounted to shower head 10 in any suitable fashion. For example, a proper flange 18, with a bayonet fitting or a snap fit release on a peripheral part of the first plate 13 is one of many foreseen mountings. While numerous variants are possible, they do not in any way change the manner in which the device works. For example, in cases where the removal of the aerator device is to be left to the discretion of the user, the previously described mounting systems are suitably placed that include bayonet, friction or snap fit couplings. In cases where the aerator device is to be separated from the shower only for cleaning and maintenance operations, it can still be attached in these ways or also by means of screws. In cases where the aerator device is to be applied to the shower in a non-removable fashion, the second plate may also be attached by means of welding or gluing. As a technically equivalent arrangement the second plate may be integrally formed as a single body with the other parts of the shower and the first plate is mounted behind it from inside the water chamber 11. In cases where the second plate must be capable of being removable it is advisable to place indicators such as a key so as to assure that the plate 16 will then be reassembled in the correct position.

Furthermore, at least one air intake 19 extends from the air chamber 20 to the outside ambient environment. In the form shown, this air intake includes openings 19 made in peripheral flange 18 that services to mount the aeration device 15 to shower 10, but many other arrangements are possible.

The device works in the following manner. Each water jet produced by a hole 14 of the first plate 13 is highly accelerated because of the small cross-section of holes 14 and the pressure from the supply connections 12. Due to the Venturi effect, as the water jet penetrates into the corresponding hole 17 due to the second plate 16, the water draws in or aspirates the air present in air chamber 20. The chamber 20 thus has a slight air pressure drop or depression. Other air penetrates into chamber 20 from the outside ambient environment through air intake 19 due to the low pressure in chamber 20. The jet, which has thus aspirated air, incorporates it, and thus it emanates from hole 17 of the second plate 16 in an aerated form.

The device thus makes provision for individually aerating each of the water jets emanating from holes 14 of plate 13 of the shower. This aeration operation is performed simultaneously while the jets leave the shower, in other words, when they no longer encounter any resistance, so that there is maximum aeration efficiency.

Naturally, the resultant effect depends on various parameters, such as the shape of the holes of the plates, the reciprocal relationships of the diameter between the holes of the two plates and the distance between the two plates. The designer can achieve a desired degree of aeration by the appropriate selection of these various parameters. At the same time he can give preference to configurations that are more easily manufactured.

Figure 8:
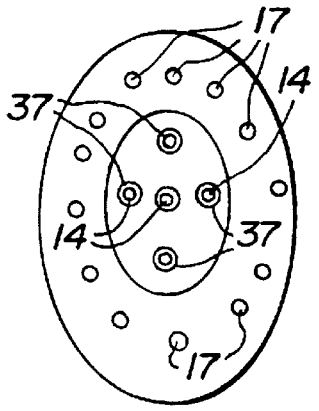
FIG. 8 is a bottom plan view illustrating a pattern of aerated and non-aerated jets.
Figure 9:
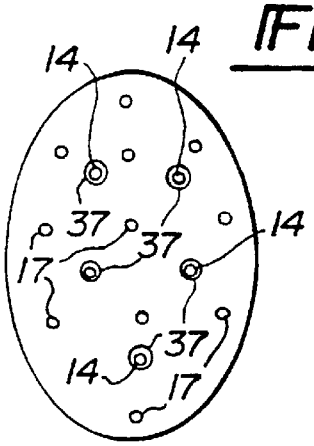
FIG. 9 is a bottom plan view illustrating a modified pattern of alternating aerated and nonaerated jets.

In the illustrated embodiment shown in FIG. 1, provision is made that the aerator device 15 acts upon all of the jets coming from the holes 14 of the first plate 13. In some cases, however, one may desire to aerate only some of the jets, for example, the peripheral jets, or only the central jets, leaving the remaining jets compact; or the jets can be alternatingly aerated and not aerated. In these cases, it suffices for some holes of the second plate 16 that corresponds to jets that must not be aerated to have a large diameter so as not to come into contact with the jets. The enlarged corresponding holes 37 as shown in FIGS. 8 and 9 of the second plate may be quite large to constitute air intakes, thus allowing the entry of air around the water jets to function as an air intake. A pattern where only the peripheral jets are aerated is illustrated in FIGS. 8. FIG. 9 illustrates another pattern of alternating aerated and non-aerated jets.

The air intake, which was shown in the form of lateral openings 19, can also be made up of holes 27 of the second plate to which the holes of the first plate do not correspond so that there will be no water flowing through them as also illustrated in FIG. 1.

A wide range of choices is available to the designer as regards the configuration of the holes of the plate. The specific configuration can be chosen freely, especially when the parts of the shower and the aerator device are made of molded plastic material. For example, FIG. 1 illustrates holes 14 of the first plate 13 and 17 of the second plate 16, all of which are flared to be of frustum shape with the hole diameter growing in the direction of water flow. The initial diameter of holes 17 is greater than the final diameter or maximum diameter of holes 14.

FIG. 2 illustrates another embodiment where holes 14 are cylindrical for most of their length and that are widened conically in the final section. Holes 17, in turn, are cylindrical with a diameter that is equal to or greater than the final diameter or maximum diameter of holes 14.

FIG. 3 illustrates another embodiment where holes 14 that are widened with generatrix curves along their entire length toward the final cross-section. Holes 17, in turn, are cylindrical with a diameter that is equal to or greater than the final i.e. maximum diameter of holes 14.

FIG. 4 illustrates further modified holes 14 that become wider with generatrix curves along their entire length toward the final cross-section. Holes 17, in turn, are cylindrical and have an initial diameter that is equal to or greater than the final diameter, i.e. maximum diameter of holes 14 and become yet wider in the final part.

FIG. 5 illustrates further modified holes 14 which, contrary to the preceding ones, become narrower toward the final section. Holes 17, in turn, are cylindrical and have a diameter that is equal to or greater than the final diameter of holes 14.

FIG. 6 shown a further variation of the device, according to FIG. 5, and, on a much larger scale. Hole 14 has a small crest 24 at it outlet facing toward the inside of the hole 14, which causes the jet, emanating from that hole itself, to become wider.

It should be noted that similar crests can also be provided in other positions, for example, at the mount of holes 14 or in intermediate positions between the mouth and the outlet of said holes. They can be provided and arranged in various ways, independently of the shape chosen for the generatrices, that is, straight or curved, of the holes themselves.

The above described construction, if desired, can have holes 14 and 17 of size and construction to obtain what is commonly referred to as "rain jets" or jets which are not continuous streams of water but discontinuous as separate drops as in a rain fall. The embodiment shown in FIG. 6 is particularly suitable for this effect.

Figure 7:
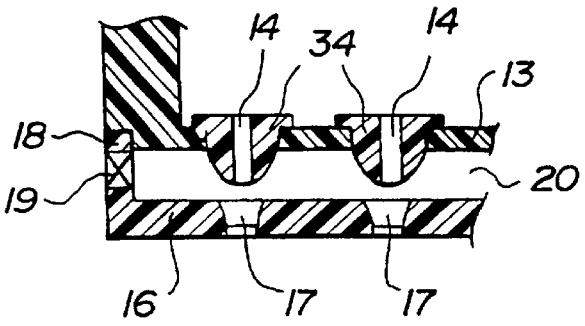
FIG. 7 shows an embodiment where the first plate is made in parts from an elastomer material.

FIG. 7 shows how holes 14 of plate 13 can be made in parts labeled 34, that are mounted to plate 13. Parts labeled 34 can be made of elastomeric material and make it possible to easily remove any lime deposits by simply momentarily deforming the parts themselves. Naturally, the same part construction can be provided in plate 16 for holes 17. Furthermore, the parts 34 can be provided with a plurality of holes rather than a single hole. The same effect can also be achieved by, on the other hand, making one or both of the plates 13 and 16 of elastomeric material. These arrangements are independent of the configurations selected for the holes.

Figure 10:
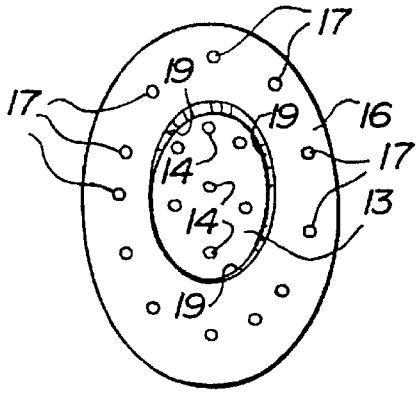
FIG. 10 is a bottom plan view illustrating an annular aerating second plate to produce peripherally positioned aerated jets and central non-aerated jets.
Figure 11:
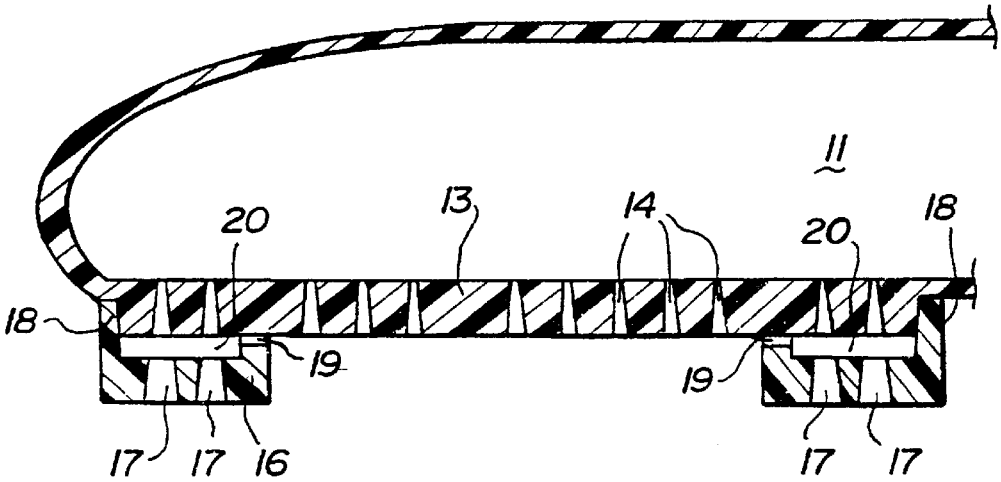
FIG. 11 is a side elevational and segmented view of the second plate and shower head shown in FIG. 10.

FIGS. 10 and 11 illustrate a modified plate 16 which covers only a portion of plate 13. The plate 17 is annular in shape with holes 17 aligned with hole 14 about the periphery of plate 13. The air chamber 20 is also annular in shape. The holes 14 in the center of plate 13 thereby produce unaerated jets while the peripheral holes 14 produce aerated jets. Furthermore, air intake apertures 19 are formed at the inner periphery of the plate 16.

It must be understood that the invention is not confined to the embodiments described and illustrated as examples. Similar modifications are within the reach of the expert in the field; for example, other configurations can be chosen for the holes of the plates and various other means can be selected to apply the aerator device to the shower in a fixed manner or a removable manner.

These and other modifications and any substitution with technical equivalents can be introduced in what was described and illustrated without departing from the scope of the invention and the coverage of this patent.

The embodiments in which an exclusive property or privilege is claimed are defined as follows:

1. An aerating device comprising a shower, the shower including a main housing having a connection for a supply of pressurized water, the main housing forming a water chamber that receives water from said supply connection, a first perforated plate that forms a wall of said water chamber, said first perforated plate being provided with a plurality of holes to project a respective water jet; said aerating device characterized by:

a second perforated plate positioned downstream of said first perforated plate to form an air chamber between the two plates;

the second perforated plate having a set of plurality of holes therethrough, each hole in the set aligned with a direction of each projection of a respective water jet from a corresponding hole in the first perforated plate;

an air intake extending from the air chamber to an exterior ambient enviroment; and said second perforated plate construction to aerate a first set of jets emanating from said first perforated plate and leaving a second set of jets emanating from said first plate unaerated.

2. An aerating device as defined in claim 1 further characterized by:

said second perforated plate being an accessory and mounted to an existing operable shower housing.

3. An aerating device as defined in claim 2 further characterized by:

said second perforated plate being removably mounted to said shower main housing.

4. An aerating device as defined in claim 1 further characterized by:

peripheral jets emanating from said first perforated plate defining one of said first and second set of jets, said first set of jets being peripheral jets and said second set of jets being central jets;

central jets emanating from said first perforated plate defining the other of said first and second set of jets.

5. An aerating device as defined in claim 1 further characterized by:

said second plate constructed to aerate alternating jets emanating from the first plate and leaving the remaining jets unaerated.

6. An aerating device as defined in claim 1 further characterized by:

said air intake including aperatures on a peripheral side of said air chamber and extending generally perpendicular to a general direction of the water jets.

7. An aerating device as defined in claim 6 further characterized by:

said air intake apertures positioned on an outer periphery of said second plate about said air chamber and extending radially outward to said exterior ambient environment.

8. An aerating device as defined in claim 1 further characterized by:

said air intake comprising apertures made in the second plate in regions that are not aligned with jets emanating from said first plate.

9. An aerating device as defined in claim 1 further characterized by:

said air intake comprising oversized apertures in said second plate through which said second set of jets pass through unaerated.

10. An aerating device as defined in claim 1 further characterized by:

said holes in said first plate having an inwardly extending neck crest that causes the outgoing jet emanating therefrom to become wider.

11. An aerating device as defined in claim 1 further characterized by:

said holes in said first plate are narrowed close to their outlets and cooperate with large diameter holes in said second plate.

12. An aerating device as defined in claim 11 further characterized by:

said holes in said first plate having an inwardly extending neck crest that causes the outgoing jet emanating therefrom to become wider.

13. An aerating device as defined in claim 1 further characterized by:

at least one of the first and second perforated plates having a yielding elastomeric section through which the holes extend such that lime deposits may be removed by mechanical deformation of the elastomeric material.

14. An aerating device as defined in claim 13 further characterized by:

one of the first and second perforated plates being made from elastomeric material.

15. An aerating device comprising a shower, the shower including a main housing having a connection for a supply of pressurized water, the main housing forming a water chamber that receives water from said supply connection, a first perforated plate that forms a wall of said water chamber, said first perforated plate being provided with a plurality of holes to project a respective water jet; said aerating device characterized by:

a second perforated plate positioned downstream of said first perforated plate to from an air chamber between the two plates;

the second perforated plate having a set of plurality of holes therethrough, each hole in the set aligned with a direction of each projection of a respective water jet from a corresponding hole in the first plate;

said holes in said first perforated plate and second perforated plate constructed to promote aeration by way of a Venturi effect;

said holes in said first perforated plate being flared from an entrance of said holes in said first perforated plate to an exit of said holes therein to become wider in the direction of water flow; and said holes in said second perforated plate having a diameter greater than a maximum diameter of the holes in the first perforated plate.

16. An aerating device as defined in claim 15 further characterized by:

said holes in said second plate being flared to become wider in the direction of water flow; and said holes in said second plate having a minimum diameter greater than the maximum diameter of the holes in the first plate.

17. An aeration device comprising a shower head, said aeration device characterized by:

a plate mounted to cover at least a portion of an outlet section of the showerhead such that a plurality of jet outlets from said showerhead are covered; the plate being spaced from the outlet section to form an air chamber therebetween;

said plate having a plurality of holes therethrough, each hole being aligned with a direction of respective water jet emanating from jet outlets from the showerhead and said holes being flared from an entrance of said holes in said plate to an exit of said holes therein, such that the hole diameter grows in the direction of water flow; and an air intake extending from the air chamber to an outside ambient environment.

* * * * *